US011759027B2

(12) United States Patent
Cheng

(10) Patent No.: US 11,759,027 B2
(45) Date of Patent: Sep. 19, 2023

(54) AWNING

(71) Applicant: WONDERLAND SWITZERLAND AG, Steinhausen (CH)

(72) Inventor: Chinming Cheng, Taipei (TW)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 17/499,049

(22) Filed: Oct. 12, 2021

(65) Prior Publication Data

US 2022/0110459 A1 Apr. 14, 2022

(30) Foreign Application Priority Data

Oct. 12, 2020 (CN) ..... 202022260190.4

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025; A47D 13/027
See application file for complete search history.

(56) References Cited

U.S. PATENT DOCUMENTS 10,433,656 B2 10/2019 Lundh
10,694,867 B2 6/2020 Troutman et al.
2009/0199337 A1* 8/2009 Long ..... A47G 9/068 5/494
2010/0147910 A1* 6/2010 Schachtner ..... A47D 13/025 224/160
2014/0013509 A1* 1/2014 Gravett ..... B62B 9/108 5/494

(Continued)

FOREIGN PATENT DOCUMENTS

CA 3040573 A1 10/2019
CN 202775324 U 3/2013
CN 203195176 U 9/2013

(Continued)

OTHER PUBLICATIONS

Japanese Office Action dated Nov. 25, 2022; Japanese Patent Application No. 2021-167120; 7874 3S00; Applicant: Sakamoto.

(Continued)

*Primary Examiner* — Corey N Skurdal
(74) *Attorney, Agent, or Firm* — Quarles & Brady LLP

(57) ABSTRACT

The present disclosure discloses an awning suitable for being assembled on an infant carrier. The infant carrier includes a back bag, and a shoulder belt and a waist belt which are connected to two opposite ends of the back bag along a longitudinal direction of the back bag respectively, an end of the back bag connected to the shoulder belt is provided with a head-neck support, the awning comprises a body portion, and a first connection portion and a second connection portion which are connected to two opposite ends of the body portion along a longitudinal direction of the body portion, the first connection portion is connected to the head-neck support, the second connection portion comprises two connection belts arranged at intervals along a transverse direction of the body portion, the two connection belts are detachably connected to each other, and the awning can be stored in the head-neck support.

15 Claims, 7 Drawing Sheets

(56) References Cited

U.S. PATENT DOCUMENTS

| | | | | |
|---|---|---|---|---|
| 2014/0097215 | A1* | 4/2014 | Caperon | A47D 13/025 224/160 |
| 2019/0281995 | A1* | 9/2019 | Troutman | A47D 13/025 |

FOREIGN PATENT DOCUMENTS

| | | | |
|---|---|---|---|
| CN | 203378824 | U | 1/2014 |
| CN | 203693077 | U | 7/2014 |
| CN | 204467575 | U | 7/2015 |
| CN | 110384365 | A | 10/2019 |
| JP | 3115561 | U | 11/2005 |
| JP | 2013-116166 | A | 6/2013 |
| TW | M517571 | U | 2/2016 |

OTHER PUBLICATIONS

TW Office Action dated Nov. 7, 2022; TW Application No. 110137852; Original: Wonderland Switzerland AG.

* cited by examiner

AWNING

CROSS-REFERENCES TO RELATED APPLICATIONS

This disclosure claims priority to China Patent Application No. 2020222601904, filed on Oct. 12, 2020, and entitled "AWNING", the content of which is hereby incorporated by reference in its entirety.

TECHNICAL FIELD

The present disclosure relates to the field of products for infants or young children, in particular to an awning for infant carrier.

BACKGROUND

With the emergence of baby-carrying devices (such as infant carrier, waist stools, etc.) has allowed more and more parents to free their hands from holding their children without affecting the intimate contact with infants or young children. For example, the infant carrier can be divided into horizontal holding type, front facing type, face-to-face type, back carrying type, etc. according to the different ways for holding baby, and can be divided into special-purpose, dual-purpose, and triple-purpose according to different functions. Therefore, the infant carrier has a wide variety of types and functions.

Generally, the current infant carrier is capable of fixing the infant and young child in the arms of the parents or on the back of the parents when going out, so as to free the hands of the parents. However, when taking infants or young children out, generally, it is necessary to carry light shielding objects, such as parasols, due to weather, outdoor environment, sunlight and other reasons. Generally, it is necessary to shield these light shielding objects on the outside of the infant carrier to provide excellent shading and sun protection, so as to protect infants or young children. However, carrying these light shielding objects brings new inconvenience to use.

Therefore, it is necessary to provide an awning with a light-shielding function and a simple structure that is easy to carry and use, so as to solve the above-mentioned problems in the prior art.

SUMMARY

The present disclosure aims to provide an awning with a shading function and a simple structure that is easy to carry and use.

In order to achieve the above objective, solutions of the present disclosure provide an awning which is suitable for being assembled on an infant carrier. The infant carrier includes a back bag, and a shoulder belt and a waist belt which are connected to two opposite ends of the back bag along a longitudinal direction of the back bag respectively. An end of the back bag connected to the shoulder belt is provided with a head-neck support. The awning includes a body portion, and a first connection portion and a second connection portion which are connected to two opposite ends of the body portion along a longitudinal direction of the body portion. The first connection portion is connected to the head-neck support. The second connection portion includes two connection belts arranged at intervals along a transverse direction of the body portion. The two connection belts are detachably connected to each other, and the awning is capable of being stored in the head-neck support.

DETAILED DESCRIPTION OF THE EMBODIMENTS

In order to describe in detail technical contents, structural features, achieved objectives and effects of the present disclosure, the following detailed description will be given in conjunction with the embodiments and accompanying drawings.

Figure 1:
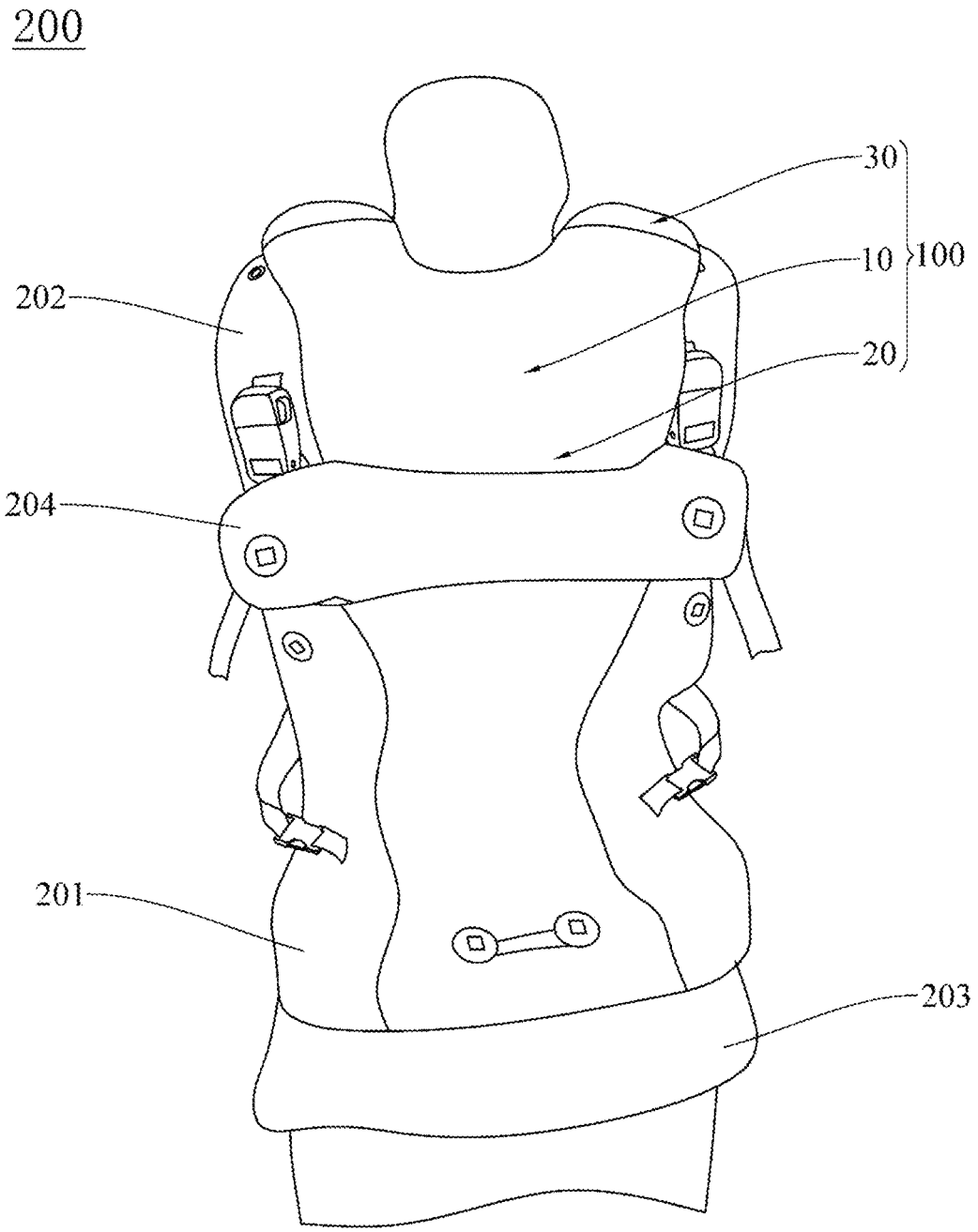
FIG. 1 is a schematic view with a perspective, illustrating that an awning of the present disclosure is assembled on a infant carrier.
Figure 2:
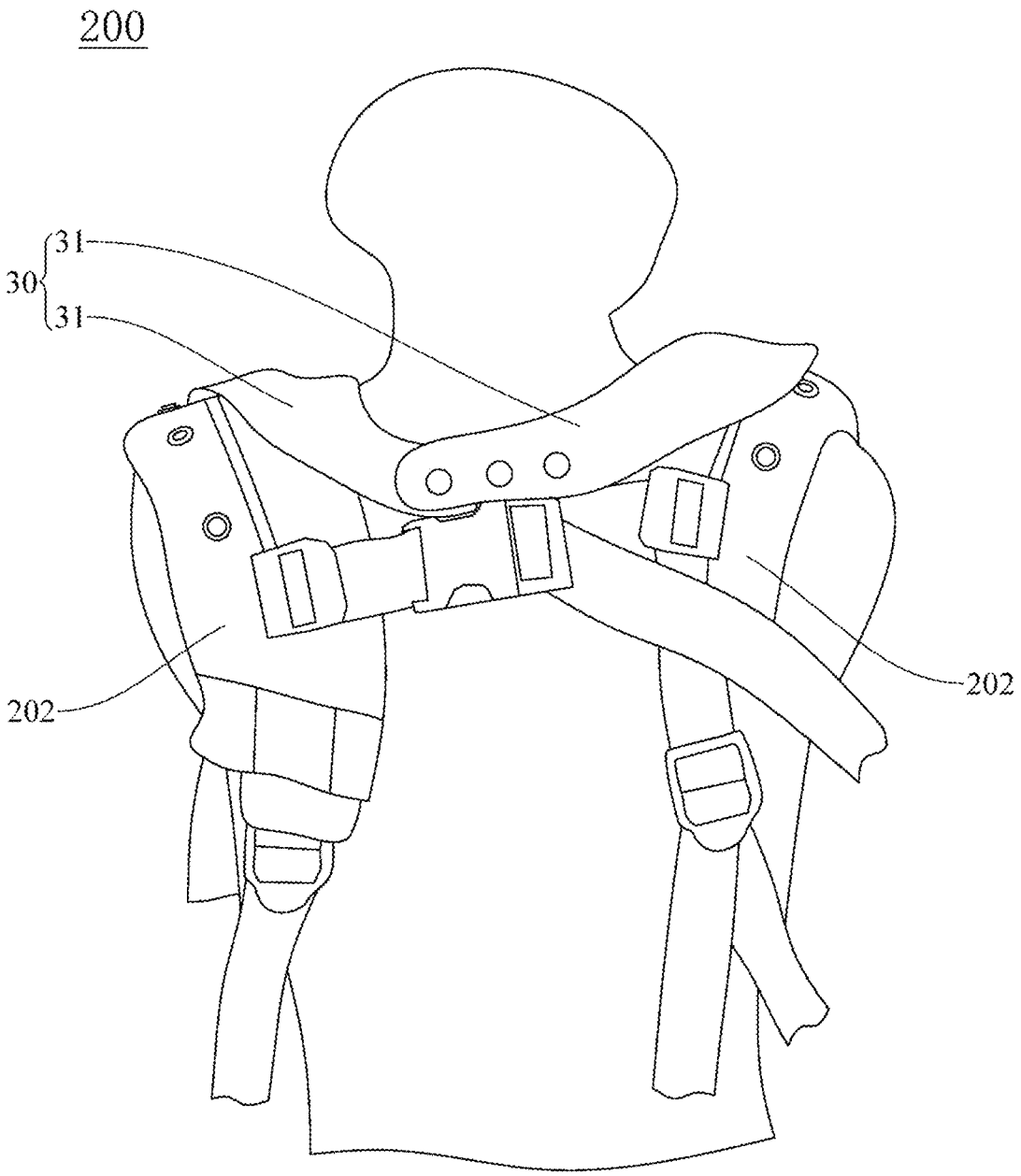
FIG. 2 is a schematic view with another perspective, illustrating that an awning of the present disclosure is assembled on a infant carrier.
Figure 3:
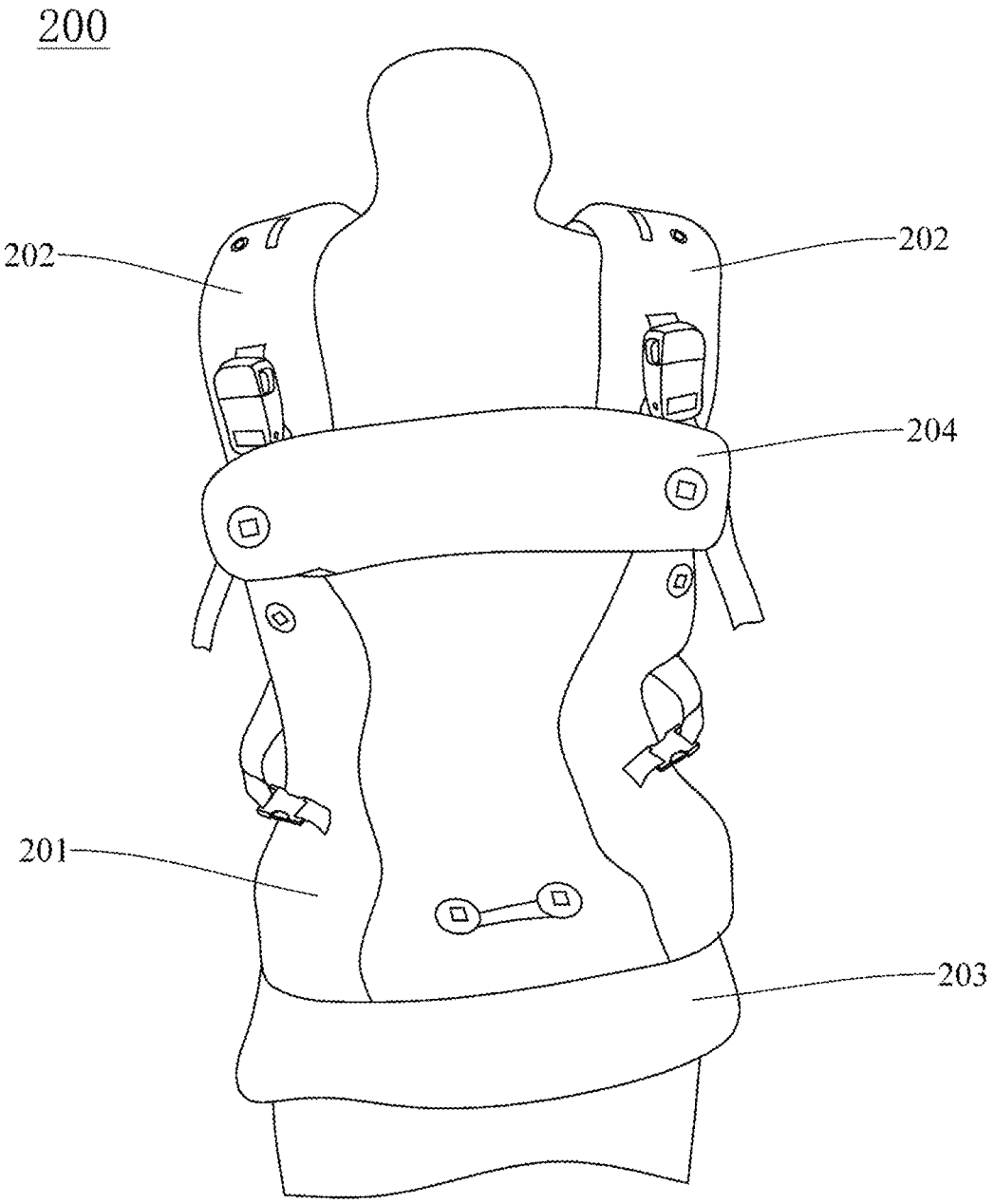
FIG. 3 is a schematic view illustrating that an awning of the present disclosure is stored in a head-neck support.

Referring to FIGS. 1 to 3, the present disclosure provides an awning 100 which is suitable for being assembled on an infant carrier 200. In a preferred embodiment of the present disclosure, the infant carrier 200 includes a back bag 201, and a shoulder belt 202 and a waist belt 203 connected to two opposite ends of the back bag 201 along a longitudinal direction of the back bag 201 respectively. The end of the back bag 201 connected to the shoulder belt 202 is provided with a head-neck support 204. The number of shoulder belts 202 is provided as two, and two shoulder belts 202 are arranged symmetrically along a transverse direction of the back bag 201. Each of the shoulder belts 202 is ring-shaped as a whole, so as to be hung on the shoulder of an user wearing the infant carrier 200. The waist belt 203 is strip-shaped as a whole, and two ends of the waist belt 203 are detachably connected to each other, so that the waist belt 203 can be conveniently fixed on the waist of user. The head-neck support 204 is configured to support the head and neck of the infant carried between the back bag 201 and the user. An end of the awning 100 of the present disclosure is connected to the head-neck support 204, and the other end of the awning 100 of the present disclosure is detachably hooked to the neck of the user, so that the awning 100 can be covered on the infants or young children to provide shading and sun protection.

In a preferred embodiment of the present disclosure, the awning 100 includes a body portion 10, and a first connection portion 20 and a second connection portion 30 which are connected to two opposite ends of the body portion 10 along a longitudinal direction of the body portion 10. The first connection portion 20 is connected to the head-neck support 204. The second connection portion 30 includes two connection belts 31 arranged at intervals along a transverse direction of the body portion 10. The two connection belts 31 are detachably connected to each other, so as to be connected to each other at the back of the user's neck, so that the two connected connection belts 31 can form a hanging belt. A wearing space is formed between the two connected connection belts 31 and the body portion 10, so that the two connected connection belts 31 can be hung on the shoulders and necks of the user wearing the infant carrier 200. In this way, the body portion 10 extends from the head-neck support 204 and is covered on the body of the infants or young children, thereby providing shading and sun protection. Preferably, the two connection belts 31 are arranged symmetrically along the transverse direction of the body portion 10, thereby facilitating connection and use. In addition, the awning 100 of the present disclosure can further be stored in the head-neck support 204. When in use, the awning 100 can be taken out of the head-neck support 204 to provide shading and sun protection. When not in use, the awning 100 can be stored in the head-neck support 204. As a result, the awning 100 of the present disclosure not only provides shading and sun protection, but also is convenient to carry and use.

Figure 4:
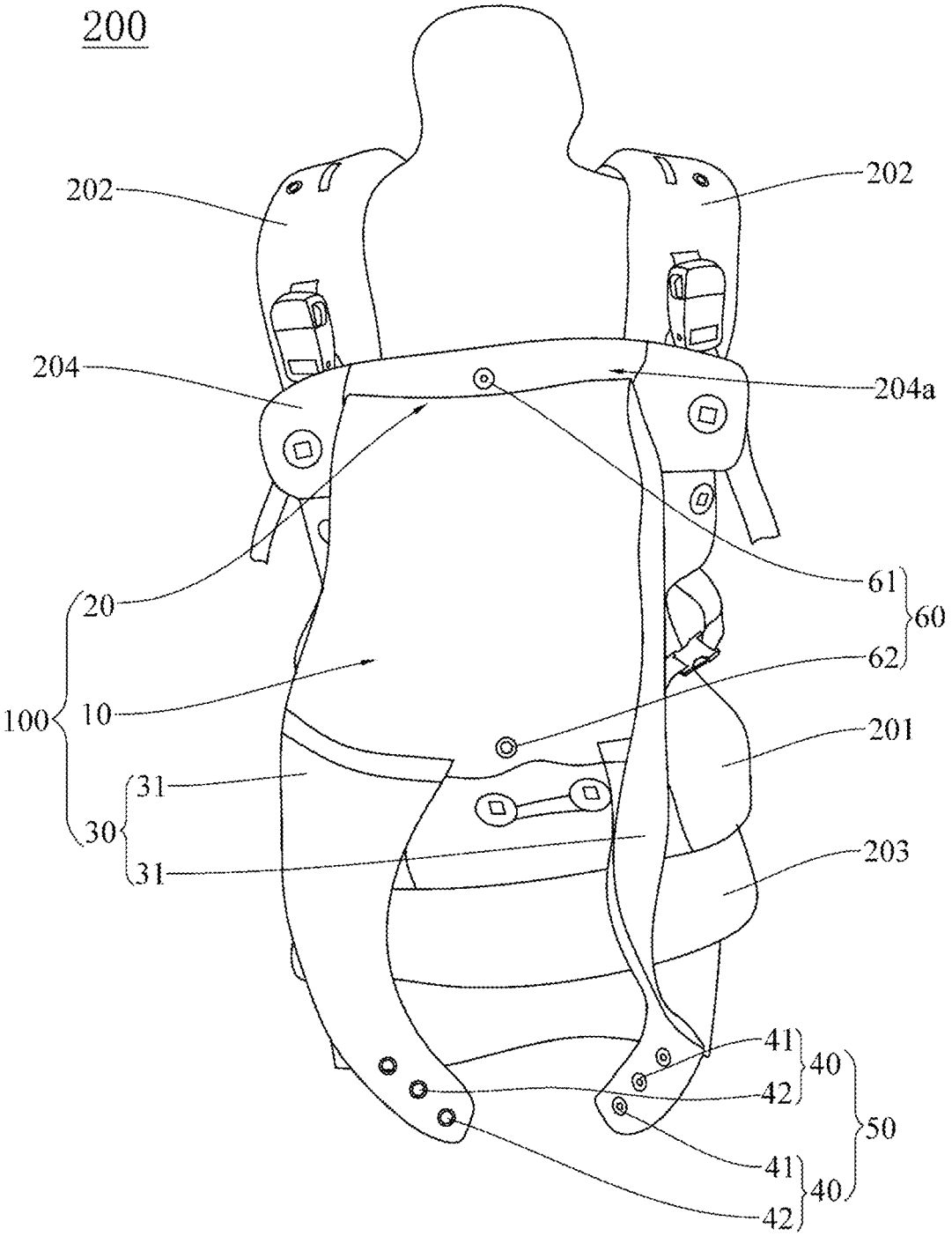
FIG. 4 is a schematic view illustrating that an awning is fixed and connected to a head-neck support in a first embodiment of the present disclosure.

Referring FIG. 4, specifically, in a first embodiment of the present disclosure, in order to realize the detachable connection between the two connection belts 31, each of the two connection belts 31 is provided with a connection member 40, and the connection member 40 can be any one of a fixing button and hole matched detachably, a drawstring, a buckle, and a Velcro. Of course, in other embodiments, in order to simplify structures, the two connection belts 31 may be directly and detachably connected to each other.

Preferably, in this embodiment, a height of the body portion 10 is adjustable. Specifically, the second connection portion 30 is provided with an adjusting member 50. The adjusting member 50 is provided on each of the two connection belts 31 along a longitudinal direction of the second connection portion 30. The adjusting member 50 has at least one adjusting section, so that the body portion 10 has different use heights based on different connection positions of the two connection belts 31. More specifically, the adjusting member 50 includes a plurality of connection members 40 arranged at intervals along the longitudinal direction of the second connection portion 30. The connection members 40 are specifically any one of a fixing button and hole matched detachably, a plug-in buckle, a snap buckle, a Velcro or a strap. As shown in FIG. 4, the connection members 40 include a male buckle 41 and a female buckle 42 that are separately provided on the two connection belts 31 and detachably matched with each other. The plurality of connection members 40 are correspondingly arranged on the two connection belts 31 to form the adjusting member 50.

Further referring FIG. 4, in order to allow the awning 100 to be stored in the head-neck support 204, the head-neck support 204 has a storage space 204*a*, in which the awning 100 can be stored. Specifically, a storage opening of the storage space 204*a* is located at the top or side end of the head-neck support 204. In order to improve the storage effect and make the whole neat and beautiful, the storage opening of the storage space 204*a* is provided with a sealing member 60. The sealing member 60 is any one of a fixing button and hole matched with each other, a buckle, a zipper, and a Velcro, thus, the sealing member 60 has a simple structure and is easy to use. As shown in FIG. 4, the sealing member 60 includes a male buckle 61 and a female buckle 62 that are matched with each other.

It should be noted that in this embodiment, the first connection portion 20 is fixed and connected in the storage space 204*a*, or is fixed and connected to an edge of the storage space 204*a*, and the second connection portion 30 can be folded toward the storage space 204*a*, so that the awning 100 can be stored in the storage space 204*a*. Specifically, the first connection portion 20 and the head-neck support 204 are connected by sewing, which has a simple structure and is convenient for processing and manufacturing.

Figure 5:
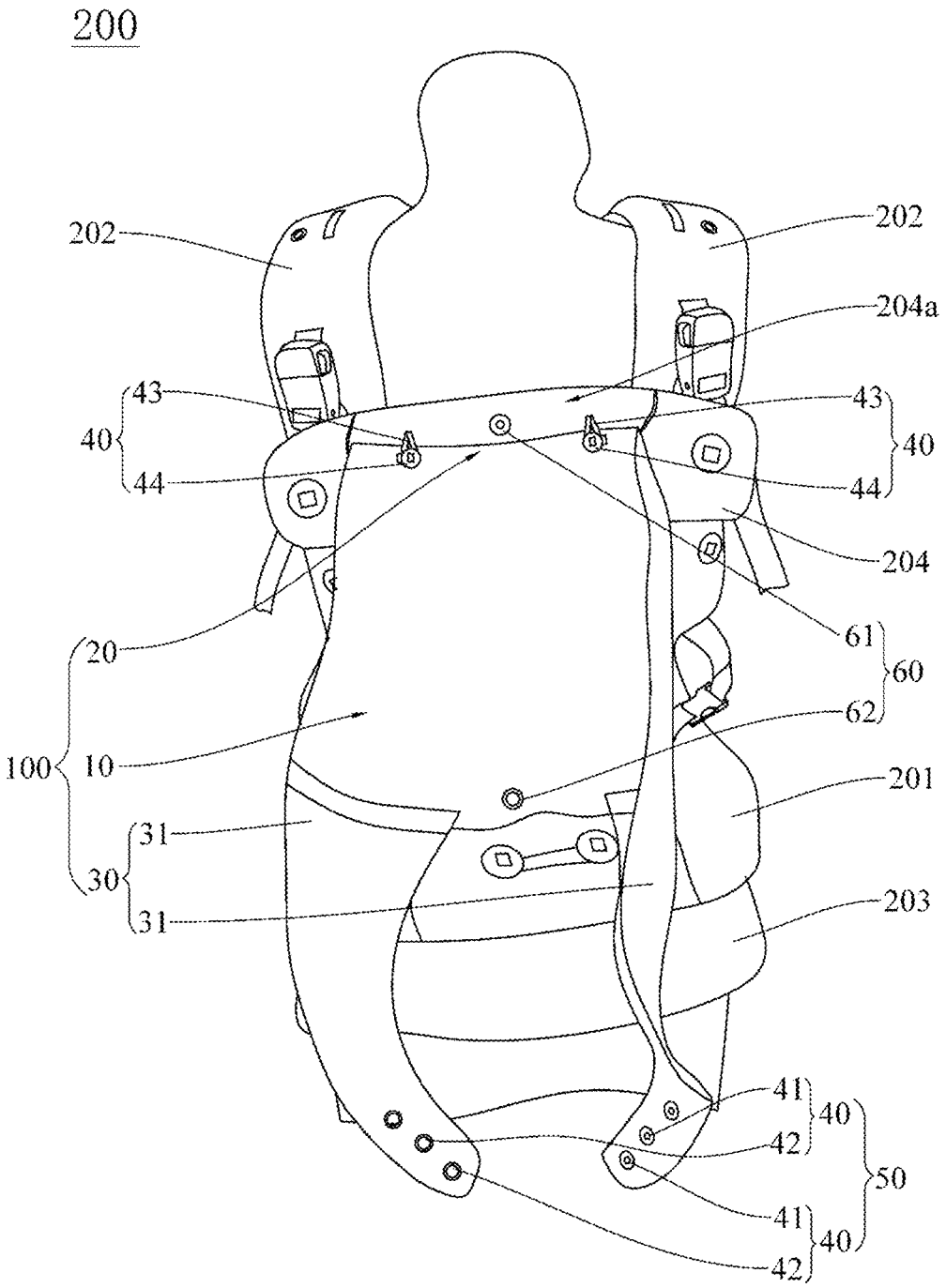
FIG. 5 is a schematic view illustrating that an awning is detachably connected to a head-neck support in a second embodiment of the present disclosure.
Figure 6:
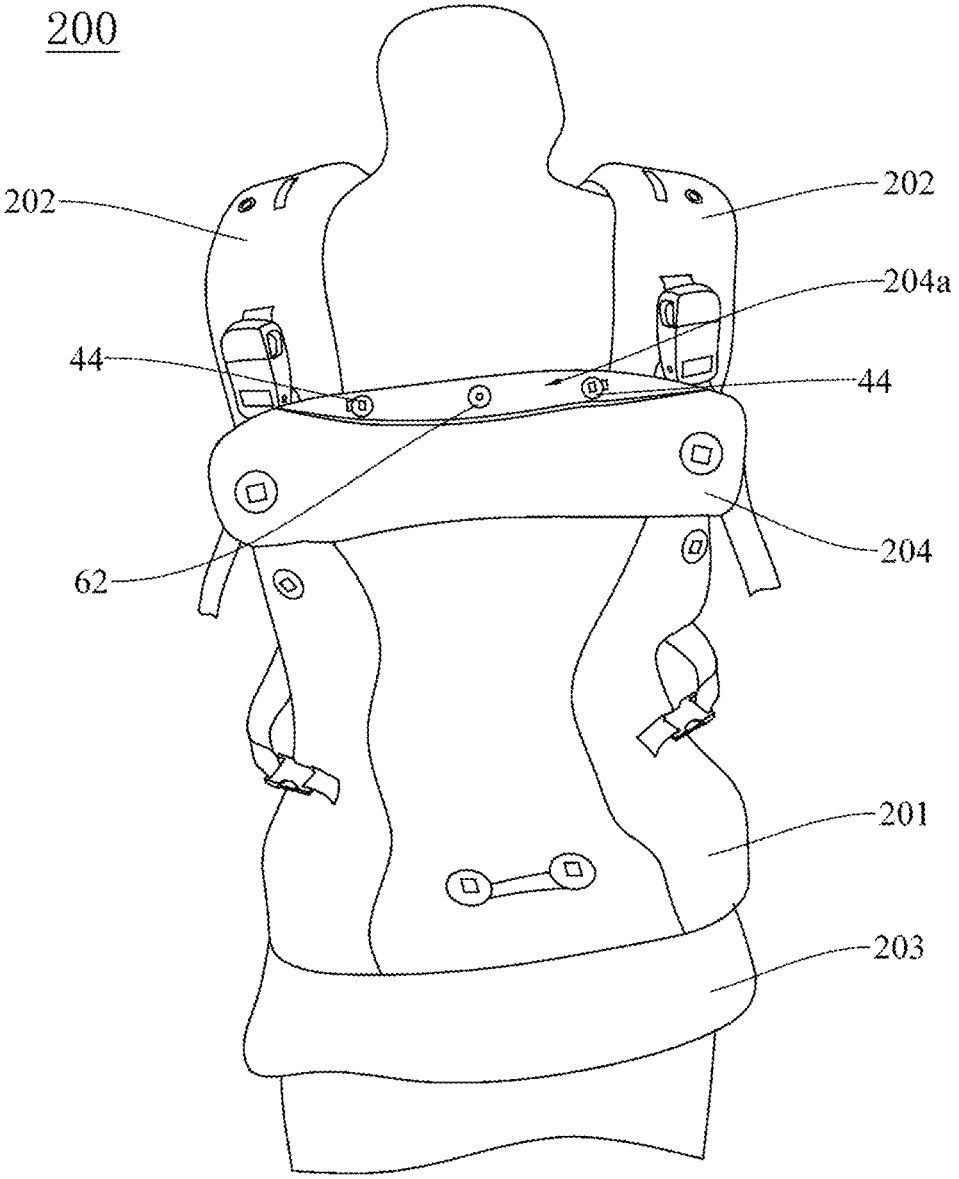
FIG. 6 is a schematic view illustrating a storage space and a sealing member in the second embodiment of the present disclosure.
Figure 7:
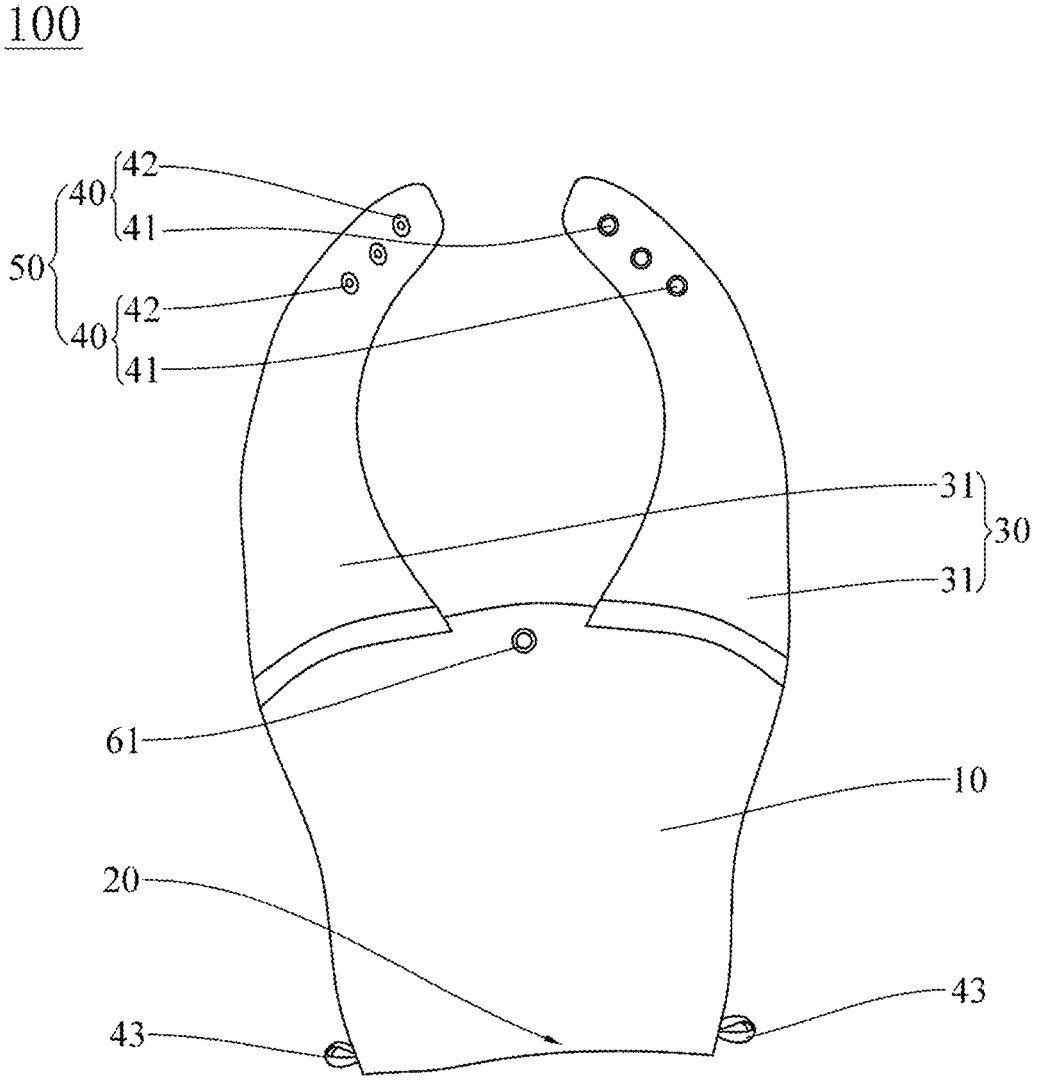
FIG. 7 is a schematic view illustrating a structure of an awning in the second embodiment of the present disclosure.

Referring FIGS. 5 to 7, in a second embodiment of the present disclosure, the difference from the first embodiment is that the first connection portion 20 is detachably connected in the storage space 204*a* or to the edge of the storage space 204*a*, and the second connection portion 30 can be folded toward a direction of the first connection portion 20, so that the awning 100 can be stored in the storage space 204*a*. Specifically, a connection member 40 is provided between the first connection portion 20 and the storage space 204*a* and between the two connection belts 31. The structure of the connection member 40 between the first connection portion 20 and the storage space 204*a* may be different from that between the two connection belts 31.

Specifically, in this embodiment, the connection member 40 between the first connection portion 20 and the storage space 204*a* includes a fixing ring 43 and a fixing buckle 44 which are provided between the first connection portion 20 and the storage space 204*a*. As shown in FIG. 6, the fixing ring 43 and the fixing buckle 44 are disposed on an inner wall of the storage space 204*a* and on the first connection portion 20, correspondingly and respectively. In FIG. 7, the fixing ring 43 and the fixing buckle 44 are disposed on the first connection portion 20 and the inner wall of the space 204*a*, correspondingly and respectively. As long as the fixing ring 43 is buckled with the fixing buckle 44, the connection between the awning 100 and the head-neck support 204 can be realized. The connection member 40 between the two connection belts 31 includes a male buckle 41 and a female buckle 42 that are respectively provided on the two connection belts 31 and are detachably matched with each other. The two connection belts 31 are connected with each other by buckling the male buckle 41 with the female buckle 42. A plurality of connection members 40 are arranged correspondingly on the two connection belts 31 to form an adjusting member 50 for adjusting the height of the body portion 10.

Compared with the prior art, the awning 100 of the present disclosure includes a body portion 10, and a first connection portion 20 and a second connection portion 30 which are connected to the two opposite ends of the body portion 10 along a longitudinal direction of the body portion 10. The second connection portion 30 includes two connection belts 31 arranged at intervals along the transverse direction of the body portion 10. The first connection portion 20 is connected to the head-neck support 204, and the two connection belts 31 are detachably connected to each other. Therefore, according to actual needs, the two connection belts 31 can be connected at the back of the user's neck to be hung on the user's shoulder and neck, thereby allowing the body portion 10 to be covered the outside of the head-neck support 204. Therefore, the awning 100 of the present disclosure is capable of providing shading and sun protection, and effectively protecting infants or young children when going out. In addition, since the awning 100 can be stored in the head-neck support 204, it is convenient to carry and use. The awning 100 of the present disclosure has a simple structure, is easy to carry and use, and effectively improves the comfort of use of the infant carrier 200 with the awning 100.

The above-disclosed are only the preferred embodiments of the present disclosure, which are not intended to limit the scope of protection of the present disclosure. Therefore, equivalent changes made according to the scope of the present disclosure still fall within the scope of the present disclosure.

What is claimed is:

1. An apparatus, comprising an infant carrier and an awning configured to be assembled on the infant carrier, the infant carrier comprising:

a back bag; and a shoulder belt and a waist belt which are connected to two opposite ends of the back bag along a longitudinal direction of the back bag respectively, an end of the back bag connected to the shoulder belt being provided with a head-neck support;

wherein the awning comprises a body portion, and a first connection portion and a second connection portion which are connected to two opposite ends of the body portion along a longitudinal direction of the body portion, the first connection portion is connected to the head-neck support, the second connection portion comprises two connection belts arranged at intervals along a transverse direction of the body portion, the two connection belts are detachably connected to each other, and the awning is capable of being stored in the head-neck support.

2. The apparatus of claim 1, wherein the two connection belts are arranged symmetrically along the transverse direction of the body portion.

3. The apparatus of claim 1, wherein the two connection belts are connected with each other to form a hanging belt, and a wearing space is formed between the two connected connection belts and the body portion.

4. The apparatus of claim 1, wherein each of the two connection belts is provided with a connection member, and the connection member is any one of a fixing button and hole matched detachably, a drawstring, a buckle, and a Velcro.

5. The apparatus of claim 1, wherein the two connection belts are detachably tied together.

6. The apparatus of claim 1, wherein a height of the body portion is adjustable.

7. The apparatus of claim 6, wherein the second connection portion is provided with an adjusting member, the adjusting member is provided on each of the two connection belts along a longitudinal direction of the second connection portion, the adjusting member has at least one adjusting section, so that the body portion has different use heights based on different connection positions of the two connection belts.

8. The apparatus of claim 7, wherein the adjusting member comprises a plurality of connection members arranged at intervals along the longitudinal direction of the second connection portion, the plurality of connection members are any one of a fixing button and hole matched detachably, a plug-in buckle, a snap buckle, a Velcro or a strap.

9. The apparatus of claim 1, wherein the head-neck support has a storage space in which the awning can be stored.

10. The apparatus of claim 9, wherein a storage opening of the storage space is located at a top or side end of the head-neck support.

11. The apparatus of claim 9, wherein the storage opening of the storage space is provided with a sealing member, and the sealing member is any one of a fixing button and hole matched with each other, a buckle, a zipper, and a Velcro.

12. The apparatus of claim 9, wherein the first connection portion is fixed and connected in the storage space, or is fixed and connected to an edge of the storage space, and the second connection portion can be folded toward the storage space, so that the awning can be stored in the storage space.

13. The apparatus of claim 12, wherein the first connection portion and the head-neck support are connected by sewing.

14. The apparatus of claim 9, wherein the first connection portion is detachably connected in the storage space or to the edge of the storage space, and the second connection portion can be folded toward a direction of the first connection portion, so that the awning can be stored in the storage space.

15. The apparatus of claim 14, wherein a connection member is provided between the first connection portion and the storage space and between the two connection belts, and the connection member is any one of a fixing button and hole matched detachably, a plug-in buckle, a snap buckle, a Velcro or a strap.

* * * * *